United States Patent [19]

Pinkerton et al.

[11] Patent Number: 4,691,974

[45] Date of Patent: Sep. 8, 1987

[54] SAFETY COVERS FOR ELECTRIC OUTLETS

[76] Inventors: Michael B. Pinkerton, 2015 144th SE., Bellevue, Wash. 98007; David Moskowitz, 1803 127th SE., Bellevue, Wash. 98005

[21] Appl. No.: 815,528

[22] Filed: Mar. 17, 1986

[51] Int. Cl.[4] ..... H01R 13/44

[52] U.S. Cl. ..... 439/147; 439/367

[58] Field of Search ..... 339/36, 38, 39, 75 P

[56] References Cited

U.S. PATENT DOCUMENTS

| | | | |
|---|---|---|---|
| 3,363,216 | 1/1968 | Benedetto | 339/75 P |
| 3,601,757 | 8/1971 | Gober | 339/39 |
| 3,828,957 | 8/1974 | Marchant | 215/9 |
| 4,032,028 | 6/1977 | Reiss et al. | 215/217 |
| 4,076,360 | 2/1978 | Singh | 339/36 |
| 4,353,475 | 10/1982 | Kachur et al. | 215/223 |
| 4,531,800 | 7/1985 | Avener | 339/39 |

*Primary Examiner*—Gil Weidenfeld
*Assistant Examiner*—Paula A. Austin
*Attorney, Agent, or Firm*—Hughes & Cassidy

[57] ABSTRACT

A cover for restricting access to the female sockets of an electrical outlet, thereby protecting infants and small children and others of limited understanding against electrical shock. The cover includes a plate bearing externally threaded bosses which replaces the conventional outlet cover, safety caps of the push-and-twist type, and protective members which are clamped against the boss overlying the socket being protected by the safety cap to deny access to the socket, both when the socket is in use and when it is not in service.

4 Claims, 2 Drawing Figures

SAFETY COVERS FOR ELECTRIC OUTLETS

BACKGROUND OF THE INVENTION

The present invention relates to novel, improved covers which keep children and others unable to appreciate the dangers involved from gaining access to the exposed female sockets of an electrical outlet.

Typically, the novel protective covers disclosed herein will be employed to control access to the sockets of a wall outlet; and the principles of our invention will be developed primarily by relation to that application. It is to be understood that this is being done for the sake of convenience and clarity, however, and that this approach is not intended to limit the scope of our invention as defined in the appended claims.

An astonishing number of children are injured, maimed, and killed each year either by direct contact with a live electrical socket or by inserting a paper clip, knife blade, or other artifact into that socket.

A number of devices designed to control access to such sockets have heretofore been proposed. Without exception, they are relatively ineffective or too complex and expensive to be practical.

One heretofore proposed solution to the problem of controlling access to electrical outlets is described in U.S. Pat. No. 4,531,800 issued July 30, 1985, to Avener for PROTECTOR DEVICE FOR ELECTRICAL OUTLETS. The Avener device is complex, employing as it does split caps with locking tabs and collars of a relatively complicated configuration. Furthermore, the Avener device furnishes only a limited degree of protection unless a line cord is routed through it because there is an opening in the end of the Avener split cap through which a hairpin, paper clip, etc., could easily be inserted.

U.S. Pat. Nos. 3,363,216 issued Jan. 9, 1968, to Benedetto for SAFETY ATTACHMENT FOR ELECTRICAL OUTLET FIXTURES; 3,601,757 issed Aug. 24, 1971, to Gober for MALE PLUG RETAINER; and 4,076,360 issued Feb. 28, 1978, to Singh for SAFETY DEVICE FOR ELECTRICAL CONNECTOR DEVICE disclose yet another solution to the problem. These patentees employ internally threaded caps to control the access to electrical outlets. Their devices have the decided disadvantage that even a small child could readily unscrew the threaded caps the patentees employ. Consequently, the devices in question have only limited effectiveness. Furthermore, like that disclosed in Avener, the safety caps and associated components employed by Benedetto and Gober have openings through which a conductive artifact such as one of those identified above could easily be poked, also making these devices too ineffective to be practical.

Another protective device, disclosed in U.S. Pat. No. 3,955,870 issued May 11, 1976, to Wasserman for UTILITY OUTLET CORD, discloses relatively complex protective devices which must be employed on a one-to-one basis with the sockets to be protected. Like others of those discussed above, Wasserman's device also has the decided disadvantage that, when a line cord is not routed through it, there is an opening through which foreign objects could be poked.

Another access controlling device of which applicants are aware is disclosed in U.S. Pat. No. 3,656,083 issued Apr. 11, 1972, to Brook for ELECTRICAL SAFETY DEVICE. The Brook devices have threaded, snap-in and bayonet connections, all of which could be easily defeated by a curious child. And, again, there appear to be openings in all of the caps disclosed by Brook through which foreign objects could readily be inserted.

SUMMARY OF THE INVENTION

We have now invented, and disclosed herein, novel, improved protective devices for electrical outlets. These protective devices are free of those above-discussed disadvantages of the prior art devices known to us in that they are effective and, at the same time, sufficiently simple to be economically attractive.

Our novel protective device is a cover which replaces the conventional outlet cover and can be attached to an electrical box by the same type of screw as is employed to attach a conventional cover. Our cover includes a plate resembling the conventional one and, integrated therewith, externally threaded bosses. These bosses surround openings fashioned in the plate and aligned with the female socket or sockets of the outlet when the cover is attached. Threadable onto these bosses are caps through which openings aligned with those in the cover's plate are formed.

The cooperating threads on the caps and bosses are so configured that the cap must be pressed toward the cover plate and simultaneously rotated to engage these threads. This scheme has been employed for a considerable time in closures for containers designed to contain medicines and other toxic substances, and it has been found to be essentially childproof.

Representative safety closures of the character just described are disclosed in U.S. Pat. Nos.: 3,828,957 issued Aug. 13, 1974, to Marchant for CONTAINER WITH SAFETY CLOSURE; 4,032,028 issued June 28, 1977, to Reiss et al. for SAFETY CAP; and 4,353,475 issued Oct. 12, 1982, to Kachur et al. for SAFETY CLOSURE DEVICE.

When the socket of an outlet equipped with the present invention is not in use, a (typically) disk-like barrier component is installed in the cap. The latter is then threaded onto that boss of the cover overlying the socket to be protected, clamping the barrier component against the boss. This completely isolates the socket from fingers, tongues, and other anatomical members, and from tableware, hairpins, and other foreign objects.

To similarly preclude access to a female socket being used, our novel covers are supplied with dome-shaped and flanged components which are formed of a resilient material and split from end-to-end, providing a gap through which the line cord can be inserted after that cord has been routed through the safety cap. The prongs of the plug attached to the line cord are then inserted into the female socket and the cap tightened onto the boss of the cover associated with that socket. This traps the dome-shaped component against the boss, again totally precluding access to the socket being used.

Alternates to that embodiment of our invention just summarized may, of course, be employed. For example, to protect a socket not in use, an internally threaded safety cap like that described above but with a solid rather than flanged top may be employed instead of the combination of the latter and a protective disk.

OBJECTS OF THE INVENTION

From the foregoing, it will be apparent to the reader that one important and primary object of our invention resides in the provision of novel, improved protective covers for controlling the access to electrical outlets.

Another also important and primary object of the invention is the provision of protective covers for electrical outlets which are more effective in preventing access to the sockets being protected than those heretofore available protective devices of which we are award.

Still another object of our invention resides in the provision of protective covers for electrical outlets which are simple and can therefore be furnished at a sufficiently low cost to make them economically attractive.

Other important objects and features and additional advantages of our invention will be apparent to the reader from the foregoing and the appended claims and as the ensuing detailed description and discussion proceeds in conjunction with the accompanying drawing.

DETAILED DESCRIPTION OF THE INVENTION

Figure 1:
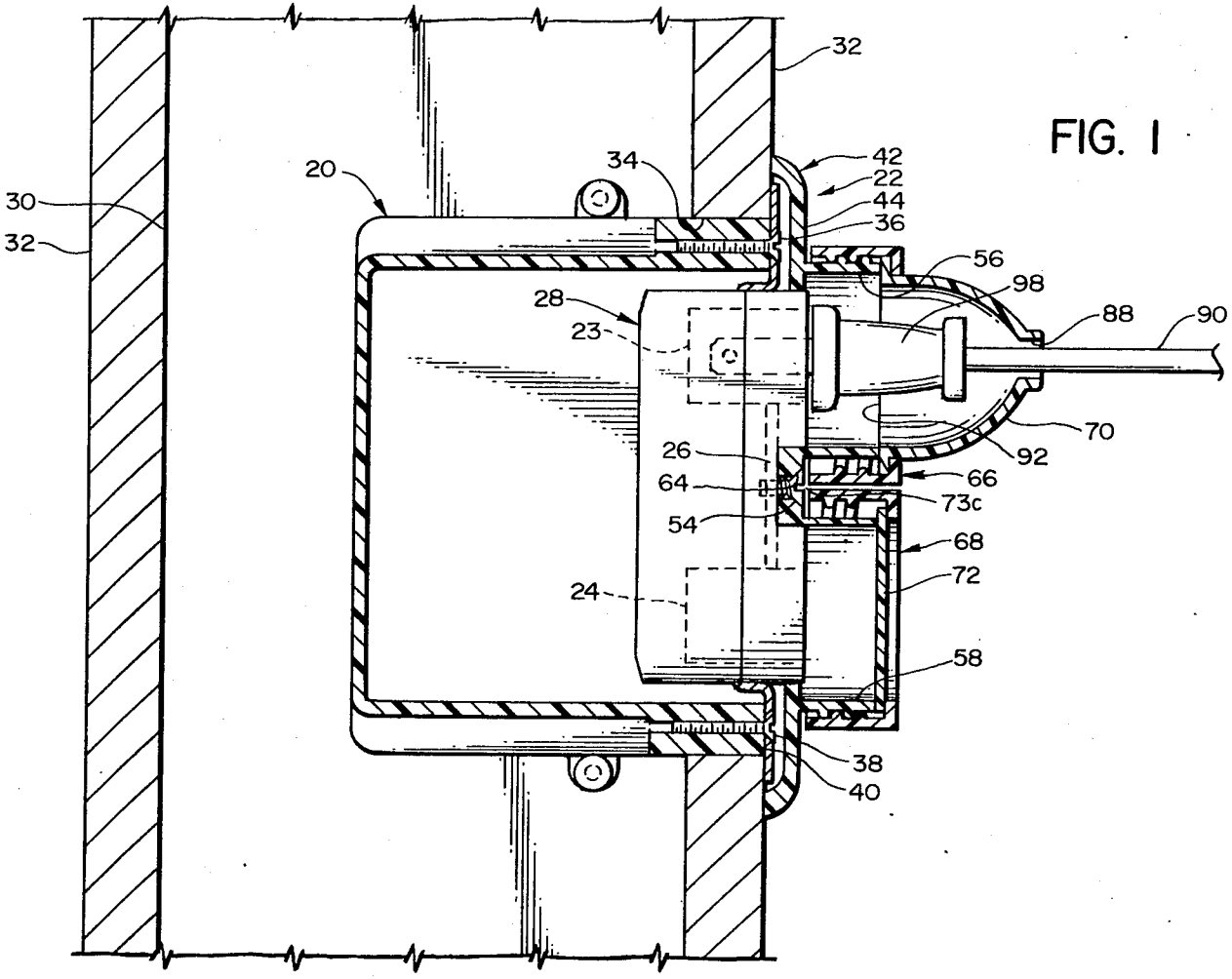
FIG. 1 is a section through an electrical wall outlet to which access has been restricted by attaching to the box in which the outlet is housed a protective cover embodying the principles of the present invention.
Figure 2:
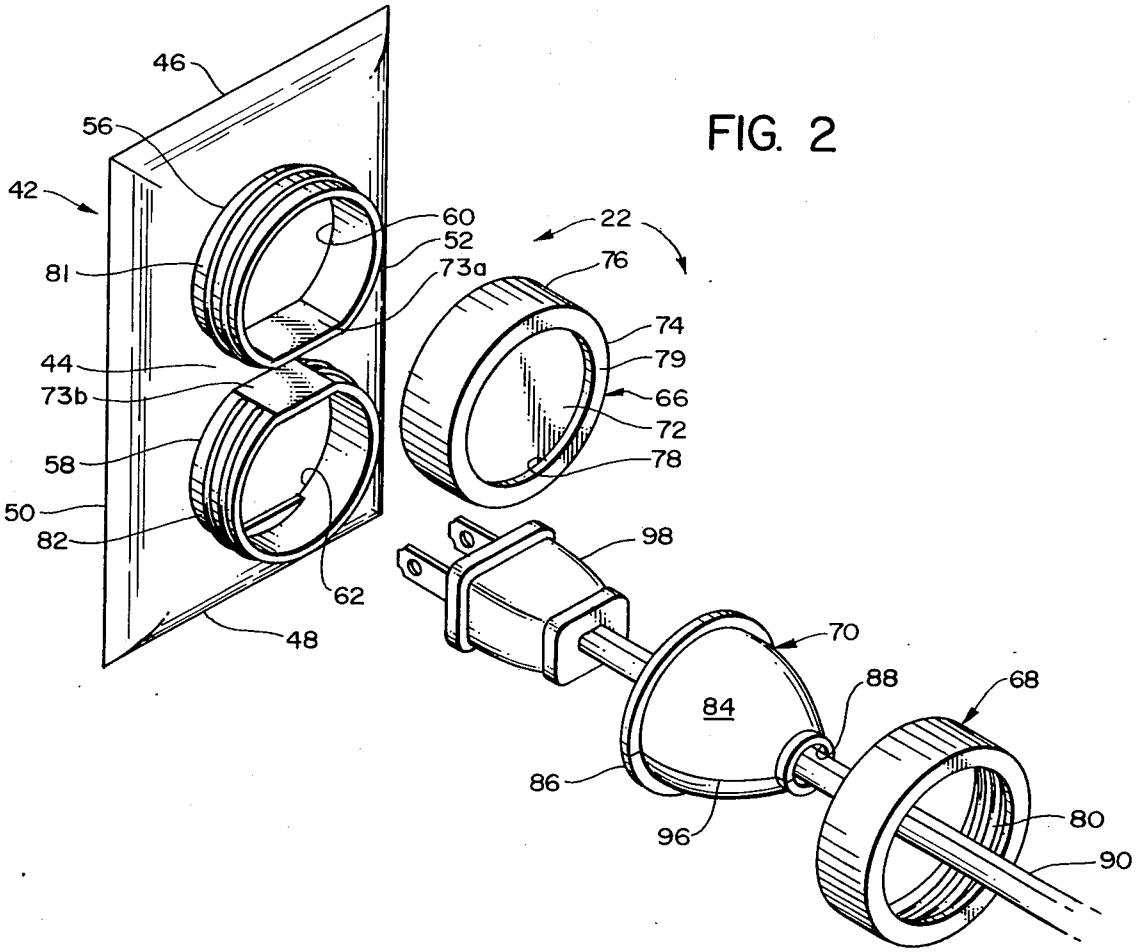
FIG. 2 is an exploded view of the protective cover.

Referring now to the drawing, FIGS. 1 and 2 depict, in detail, an electrical outlet 20 to which access is limited by a protective cover 22 constructed in accord with, and embodying, the principles of the present invention.

Outlet 20 is of conventional construction; it includes sockets 23 and 24 supported from a bracket 26. As is required by code, the outlet is housed in an electrical box 28. In the exemplary installation shown in FIG. 1, this box is attached to a vertical stud 30 of a wall which also includes drywall 32 attached to the stud. A cut-out 34 in the drywall affords access to sockets 23 and 24.

Outlet 20 is attached to box 28 by the usual screws 36 and 38 with sockets 23 and 24 facing the open side 40 of the box.

Referring now to FIG. 1 and to FIG. 2, protective cover 22 includes a rectangular plate 42 which has a top wall 44 bounded by angularly inclined upper, lower, and side walls 46, 48, 50, and 52. To all intents and purposes, plate 42 may be identical to the conventional outlet cover plate; and it is attached to the bracket 26 of outlet 20 like the latter by the customary screw 54.

Plate 42 differs from a conventional outlet plate in that it includes integral, externally threaded bossed 56 and 58 which surround openings 60 and 62 through the top wall 44 of the plate. These openings are so located that they are aligned with sockets 23 and 24 when plate 42 is attached to outlet 20 by inserting screw 54 through the aperture 64 in top wall 44 and then threading that screw through the socket supporting bracket 26 of the outlet 20.

In addition to plate 42, protective cover 22 includes a pair of safety caps 66 and 68, two dome-shaped protective shields, and two disk-like protective members. One shield and one protective member are shown. They are identified by reference characters 70 and 72, respectively.

It is desirable to make bosses 56 and 58 as large in diameter as possible so that they can accommodate oversized and odd-shaped plugs. FIG. 1 makes it clear that the limiting factor in maximizing the diameters of bosses 56 and 58 is the diameter of safety caps 66 and 68 which must be free to rotate relative to each other when both caps are in place; i.e., screwed onto bosses 56 and 58.

FIG. 1 also makes it clear that, with this criteria met and the diameters of bosses 56 and 58 maximized, the screw 54 attaching plate 42 to electrical outlet bracket 26 could not be installed if the two bosses were of a completely cylindrical configuration. Therefore, facing flats 73*a* and 73*b* are formed on bosses 56 and 58, respectively. These flats lie within the envelopes of bosses 56 and 58, creating an open space 73*c* for the aperture 64 in plate 42 through which screw 54 extends and a space between the bosses through which a screwdriver can be fitted to tighten and loosen the screw.

As is best shown in FI. 2, each of the two safety caps has a flat top wall 74 surrounded by a cylindrical, internally threaded sidewall 76. An aperture 78 through which a line cord and a male plug attached to the end of that cord can be routed is formed in top wall 74, leaving a surrounding flange or rim 79.

One of the important features of the present invention is that the internal threads 80 in the safety caps and the external threads 81 and 82 on bosses 56 and 58 are so formed that, to engage these threads so that the safety cap may be removed from the boss on which it is threaded, the cap must be firmly pressed toward plate 42 of the protective device and simultaneously rotated in a counterclockwise direction. That is, the safety caps are of the press-and-twist type. As discussed above, past experience has shown that this scheme is essentially childproof which is one of the important goals of the present invention.

The protective disks 72 are designed to be employed when a socket is not being used. They are dimensioned to fit within the safety cap with which they are associated and to be trapped against the boss 56 or 58 on which the safety cap is threaded by the annular flange constituted by the top wall 74 of the safety cap. This completely precludes access to the socket 23 or 24, essentially eliminating any possibility of an anatomical member or foreign object coming into contact with the socket.

Instead of protective disk 72, the dome-shaped shield 70 mentioned briefly above is employed to preclude access to a socket in use. This shield, which is formed of any suitable resilient material, includes a dome 84 and an annular flange 86. An opening 88 through which a line cord 90 can be routed, and which is dimensioned to closely surround the line cord, is formed in the closed end of dome 84. The opposite, open end 92 of this part is surrounded by the integral, or integrated, annular flange or rim 86.

Protective shield 70 is split from end-to-end, providing the gap 96 shown in FIG. 2. This allows the protective shield to be pried apart so that line cord 90 can be installed in it as shown in the same figure.

To use protective cover 22 to preclude access to an electrical socket in use, the line cord 90 and plug 98 attached to the end of that cord are first routed through the safety cap (66 or 68). Protective shield 70 is then installed over line cord 90 in the manner just described between plug 98 and the safety cap. Next, plug 98 is plugged into one of the two female sockets 23 or 24 of outlet 20. Then, protective shield 70 is slid down line cord 90 until flange 86 abuts the boss 56 or 58 of the protective cover overlying the socket being put into service. Finally, the safety cap is threaded onto the boss to trap the flange 86 of the protective shield between the boss and te top wall flange 79 of the safety cap. Again, the scheme is one which completely precludes access to the female socket in use.

In the just-concluded detailed description of our invention, several references to orientations such as top, side, upper, lower, etc., were made. This was done for the sake of brevity and of clearly explaining the invention and is not intended to impose any restrictions on the scope of our invention as defined in the appended claims.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description; and all changes which come within the meaning and range of equivalency of the claims are therefore intended to be embraced therein.

What we claim as our invention is:

1. A protective cover for an electrical outlet having an exposed female connector, said cover including: a plate which is adapted to fit over and be attached to said outlet, there being an aperture through said plate which is than aligned with said female connector and thereby allows a male connector to be plugged into the female connector; an externally threaded, cylindrical boss protruding from said plate and surrounding said aperture; and means which is or comprises an internally threaded cap adapted to be threaded onto said boss to prevent access to said female connector through said aperture, the external threads on said boss and the internal threads on said cap forming press and twist means requiring both that pressure be exerted on said cap to move it toward said plate and that the cap be simultaneously rotated to engage said external and internal threads to allow said cap to be removed from said boss.

2. A protective cover as defined in claim 1 wherein said cap has an opening in it through which a line cord and a male connector attached thereto can be routed and wherein said cap has an annular rim surrounding said opening, the means for preventing access to said female connector also including a barrier component for blocking access to said female connector through said cap, said barrier device being configured to fit within said cap and to be trapped therein and said barrier device being sufficiently large in diameter to be trapped against said boss by the annular rim of the cap.

3. A protective outlet cover as defined in claim 1 wherein said cap has an opening through which a line cord and a male connector attached thereto can be routed and an annular rim surrounding said opening, said outlet cover also including a device for precluding access to said female connector through the aperture in said cap, said just-mentioned device having an open-ended, circularly sectioned, male connector receiving dome of resilient, flexible material which is adapted to have said line cord attached male connector at least partially housed therein and an annular flange integrated with said dome at the open end thereof, there being an opening of sufficient size to accommodate only a line cord in that end of the dome opposite said flange, said device being split from end-to-end to form a gap which can be enlarged to allow a line cord to be routed through the device, and said device being so dimensioned that said cap can be slipped over said dome and then threaded on said boss to trap the flange on said device between said boss and the rim of the cap.

4. A protective cover as defined in claim 1 wherein said plate has two apertures as aforesaid, wherein each of said apertures is adapted to be aligned with one of two adjacent female connectors of an electrical outlet having at least one pair of such female connectors, wherein there is protruding boss as aforesaid surroundinng each of said apertures, and wherein the facing portions of said bosses are flat and lie within the envelopes defining the external surfaces of the bosses, thereby giving access to an area of the plate lying between the bosses.

* * * * *